US008791890B2

(12) United States Patent
Scheibe

(10) Patent No.: US 8,791,890 B2
(45) Date of Patent: Jul. 29, 2014

(54) PRESENTATION OF HIGHLY SATURATED COLORS WITH HIGH LUMINANCE

(75) Inventor: Paul O. Scheibe, Arroyo Grande, CA (US)

(73) Assignee: Landmark Screens, LLC, Palo Alto, CA (US)

( * ) Notice: Subject to any disclaimer, the term of this patent is extended or adjusted under 35 U.S.C. 154(b) by 590 days.

(21) Appl. No.: 13/080,480

(22) Filed: Apr. 5, 2011

(65) Prior Publication Data

US 2012/0256969 A1 Oct. 11, 2012

(51) Int. Cl.
*G09G 3/32* (2006.01)

(52) U.S. Cl.
USPC ..... 345/83; 345/589

(58) Field of Classification Search
USPC ..... 345/77, 82, 690, 589–593, 83, 596, 597
See application file for complete search history.

(56) References Cited

U.S. PATENT DOCUMENTS

| | | | | |
|---|---|---|---|---|
| RE40,953 | E | 11/2009 | Scheibe | |
| 7,911,442 | B2 * | 3/2011 | Wang et al. | 345/690 |
| 2004/0246265 | A1 * | 12/2004 | Starkweather | 345/589 |

OTHER PUBLICATIONS

Wyszecki, Gunter & Stiles, W.S., Color Science Concepts and Methods, Quantitative Data and Fomulae, 2nd Edition, John Wiley & Sons, Inc., New York, Table of Contents, pp. 130-248.
Bellman, Richard, Introduction to Matrix Analysis, 2nd Edition, McGraw-Hill Book Company, New York, (1970), 16 pgs.
Horn, Roger A. & Johnson, Charles R., Matrix Analysis, Cambridge University Press, Cambridge (1990), Table of Contents, Preface, pp. 1-32.
Magnus, Jan R. & Neudecker, Heinz, Matrix Differential Calculus with Applications in Statistics and Econometrics, John Wiley & Sons Ltd., (1988), 14 pgs.
Luenberger, David G. & Ye, Yinyu, Linear and Nonlinear Programming, 3rd Edition, Springer Science+Business Media, LLC, New York, (2010), 16 pgs.
Press, William H., Flannery, Brian P., Teukolsky, Saul A., Vetterling, William T., Numerical Recipes in C, The Art of Scientific Computing, Cambridge University Press, (1988), Table of Contents, Preface, pp. 329-343.

* cited by examiner

*Primary Examiner* — Regina Liang
(74) *Attorney, Agent, or Firm* — Edward C. Kwok; Hogan Lovells US LLP

(57) ABSTRACT

A method is applicable to a pixel of a graphical display that is formed by LEDs or LED strings, with the colors that can be displayed by the pixel (i.e., the color gamut) defined by an LED drive specification matrix A. The method displays a desired color at a chromaticity coordinates ($x_n$, $y_n$) and a luminous intensity Y by carrying out: (a) finding a maximum luminous intensity $\hat{Y}$ and the associated LED drive vector $\hat{b}$ for each of a collection of sample colors in the color gamut using a mathematical programming technique; and (b) calculating the LED drive vector for the desired color; and (c) displaying the color on the pixel using the calculated drive vector. In one implementation, the calculated LED drive vector is scaled using the expression $$\hat{b}\min\left(\frac{Y}{\hat{Y}}, 1\right).$$

(b) based on we sample colors. In addition, the method may create an interpolation function $f(x, y)$ for luminous intensity $\hat{Y}$ and LED drive vector $\hat{b}$ for colors outside of the sample colors. The interpolation function is used to evaluate $f(x_n, y_n)$ to obtain luminous intensity $\hat{Y}$ and LED drive vector $\hat{b}$ for the desired color. The interpolation function may be created off-line, and calculating the LED drive may be carried out in real time.

20 Claims, 5 Drawing Sheets

PRESENTATION OF HIGHLY SATURATED COLORS WITH HIGH LUMINANCE

BACKGROUND OF THE INVENTION

1. Field of the Invention

The present invention relates to color-rendering in a graphical display. In particular, the present invention relates to techniques in rendering highly saturated colors at high luminance in a graphical display (e.g., a light-emitting diode (LED) display) which forms images using three or more basis colors.

2. Discussion of the Related Art

In the electronic displays or signboards used in modern advertising, the images are often provided by light emitting diodes (LEDs). In a typical display, hundreds of thousands to millions of LEDs are used on a typical signboard to produce the multicolored images. The most common basis colors used in such a display are provided by red-, green-, and blue-emitting LEDs. Recently, some graphical displays use more that three basis colors.

In a typical signboard, the LEDs are arranged in small groups, with each group providing a picture element (pixel), which is the basic unit for forming the image that is shown on a graphical display. Each pixel, formed by LEDs of the basis colors is capable of displaying a wide range of colors. The collection of all colors capable of being displayed by a pixel is called a "gamut." To display any color of the gamut, the LED or LEDs of each basis color are appropriately driven to controlled intensities. The intensity of light emitted from an LED is achieve by controlling the current in the LED. As the human psychovisual system has a frequency response for temporal variations in light intensity that is essentially zero for frequencies greater than about 100 Hz[1], the typical LED driver can be modeled as a current source that is pulse modulated to produce two binary states—either zero current or a current of a reference value. In a typical display, such a driver drives either a single LED or a string of serially connected LEDs. The modulation rate is typically chosen so that the waveform has essentially no energy below 100 Hz. In addition, the duty cycle of the waveform is selected so that the average current in the LED or LEDs provide the required light intensity.

[1] Light intensity variations at below 100 Hz may result in a "flicker" sensation At present, most signboards using LEDs control the overall brightness by simply applying a common scaling factor (CSF) to all drivers in the signboard. Furthermore, the maximum luminous intensity usually occurs for a color near a daylight color. These factors together limit the signboard's ability to produce highly saturated colors at night, when the overall brightness is much less than the brightness used during the daytime.

At least three basis colors are required to form a gamut. Using more than three basis colors expands the gamut and introduces additional degrees of freedom that can be exploited for performance improvement. For example, the additional basis colors allow rendering colors located near the boundary of the expanded gamut, which are not available in a three-basis color gamut. An LED signboard which uses more than three basis colors is disclosed, for example, in U.S. Pat. RE 40953 to Paul O. Scheibe, reissued on Nov. 10, 2009, entitled "Light-emitting Diode Display," which is a reissue of U.S. Pat. No. 6,639,574, issued on Oct. 28, 2003.

FIG. 1 illustrates an example of a color gamut defined by five basis colors. The color gamut is the set of points bounded by the convex hull of points in the plane consisting of the (x, y) CIE chromatic coordinates. As shown in FIG. 1, color gamut 100 is a pentagon with its vertices defined by five basis colors. FIG. 1 uses a representation of colors using the CIE colorimetric system known to those skilled in the art. A detailed description of the CIE colorimetric system may be found, for example, in *Color Science: Concepts and Methods, Quantitative Data and Formulae, 2nd Edition*, by Gunter Wyszecki and W. S. Stiles, John Wiley & Sons, Inc., New York (1982). For a discussion of the CIE colorimetric system, see, especially, pages 130-248 and 137-142.

In the detailed description below, the CIE XYZ (tristimuli) colorimetric system and the CIE chromaticity coordinate system are used. Under the CIE XYZ (tristimulus) colorimetric system, the color of a given pixel is described by CIE XYZ coordinates (X, Y, Z). The basic colorimetric equations for the additive color mixture in an LED type color display are:

$$\sum_{p=1}^{P} b_p X_p = X \tag{1a}$$

$$\sum_{p=1}^{P} b_p Y_p = Y \tag{1b}$$

$$\sum_{p=1}^{P} b_p Z_p = Z \tag{1c}$$

where the color display is formed by pixels each containing P basis color LEDs or strings of LEDs, with the p-th basis color having CIE XYZ coordinates (Xp, Yp, Zp) at maximum luminous intensity, and where the LED drive coefficient $0 \le b_p \le 1$ providing linear luminous intensity control for basis colors p=1, . . . , P. Using vector-matrix notation, equations (1)-(3) may be compactly rewritten as (a bold lower-case letter denotes a vector):

$$Ab = v \tag{2a}$$

Where $$A = \begin{bmatrix} X_1 & \dots & X_p & \dots & X_P \\ Y_1 & \dots & Y_p & \dots & Y_P \\ Z_1 & \dots & Z_p & \dots & Z_P \end{bmatrix} \tag{2b}$$

and $$b = \begin{bmatrix} b_1 \\ \dots \\ b_2 \\ \dots \\ b_3 \end{bmatrix} \text{ and } v = \begin{bmatrix} X \\ Y \\ Z \end{bmatrix} \tag{2c}$$

Addition notational and background information may be found, for example, at (a) R. Bellman, *Introduction to Matrix Analysis, Second Edition*, McGraw-Hill Book Company, New York (1970); (b) Roger A. Horn and Charles R. Johnson, *Matrix Analysis*, Cambridge University Press, Cambridge (1988) and (c) Jan R. Magnus and Heinz Neudecker, *Matrix Differential Calculus*, John Wiley & Sons, Inc., New York (1988).

Alternatively, the CIE chromaticity coordinates (x, y, z) may be used. The chromaticity coordinates (x, y, z) satisfy $$x = \frac{X}{X+Y+Z} \quad 3a)$$

$$y = \frac{Y}{X+Y+Z} \quad 3b)$$

$$z = \frac{Z}{X+Y+Z} \quad 3c)$$

(See, for example, Gunter Wyszecki and W. S. Stiles, *Color Science: Concepts and Methods, Quantitative Data and Formulae, 2nd Edition*, John Wiley & Sons, Inc., New York (1982), page 139.) Since x+y+z=1, the pair (x, y) is also sometimes used under the CIE chromaticity coordinates system to designate the color. The value of the third coordinate (z=1−x−y) is implicitly provided. Color (x, y) and luminous intensity Y may also be represented by the triple (x, y, Y). The chromaticity coordinates are related to the CIE XYZ coordinates by:

$$X = \frac{x}{y}Y \quad 4a)$$

$$Y = \frac{y}{y}Y \quad 4b)$$

$$Z = \frac{z}{y}Y \quad 4c)$$

Given the matrix A of basis color specifications, as defined in Equation 2b), the maximum luminous intensity $\hat{Y}$ and associated control vector $\hat{b}$ may be calculated given the chromaticity coordinates (x, y) and the constraints. The resulting drive vector $\hat{b}$ can be scaled to correspond to any other choice of luminous intensity. (The chromaticity coordinates are invariant to the scaling, as can be seen from equations 3a)-3c)). If the chromaticity coordinates (x, y) of the desired color v are within the color gamut provided by the LED strings, then Eq. 2a) has solution such that all elements of b are non-negative; otherwise, the desired pixel color or luminous intensity cannot be achieved, and some approximation to the color is necessary.

Returning to FIG. 1, the chromaticity coordinates (x, y, Y) of the five vertices of color gamut 100 are blue at (0.13, 0.07, 1.56), cyan at (0.085, 0.490, 2.2), green at (0.16, 0.71, 2.92), green-yellow at (0.25, 0.70, 2.56) and red at (0.70, 0.30, 2.56). Each additional basis color increases the size of the color gamut. In this example, color gamut 100 includes three triangles 101, 102 and 103. In one implementation, color gamut 100 defines 40200 colors, with about 3700 colors in triangle 101, 4000 colors in triangle 102 and 32500 colors in triangle 103, at $\Delta E_{ab}=1$ level (i.e., the resolution at which a trained human observer can detect a subtle difference in shade) with constant luminance at Y=60. With three basis colors, a unique combination of LED drive currents produces a given color and a given luminous intensity. However, with more than three basis colors, the specified color and luminous intensity can usually be achieved by more than one combination of drive currents in the basis LEDs. Further conditions or constraints may be advantageously imposed on these drive current combinations.

SUMMARY

According to one embodiment of the present invention, a method and an apparatus drive LEDs to display highly-saturated colors over a broad region of the gamut, without sacrificing luminosity in those colors.

A method of the present invention is applicable to pixels of a graphical display that are each formed by three or more basis color LEDs or LED strings, with the colors that can be displayed by the pixel (i.e., the color gamut) defined by an LED drive specification matrix A. Prior to displaying a desired color at chromaticity coordinates $(x_n, y_n)$ and a luminous intensity Y, the method first computes a maximum luminous intensity $\hat{Y}$ and the associated LED drive vector $\hat{b}$ for each of a selected set of colors in the color gamut using a mathematical programming technique (e.g., a linear programming technique). This operation may be carried out off-line. When the desired color at the desired luminosity is to be displayed, the maximum luminous intensity $\hat{Y}$ and the associated LED drive vector $\hat{b}$ computed for that color are looked up. The drive vector to display the desired color at the desired luminosity can be obtained by scaling according to the maximum luminosity computed. The drive vector thus obtained is applied to the LEDs to display the desired color The present invention is also applicable to the situation where the desired color at $(x_n, y_n)$ and luminous intensity Y is not among the computed selected set of colors. To provide for such a color, a method of the present invention creates an interpolation function $f(x, y)$ for interpolating luminous intensity $\hat{Y}$ and LED drive vector $\hat{b}$ for each color and luminous intensity within the color gamut. When a desired color $(x_n, y_n)$ and luminous intensity Y not among the computed selected set of colors is specified, the interpolation function $f(x_n, y_n)$ is evaluated to obtain the luminous intensity $\hat{Y}$ and LED drive vector $\hat{b}$ for the desired color, after appropriate scaling, if required. The drive vector is then applied to the LEDs to display the desired color. The interpolation function may be created off-line, and calculating the actual required LED drive for the desired color at the desired luminosity may be carried out in real time.

According to another aspect of the present invention, finding a maximum luminous intensity is further based on one or more constraints. One of the constraints may constrain each element of the LED drive vector to a non-negative value. Another one of the constraints may constrain variations in the maximum luminous intensity of any color in the color gamut to be less than or equal a predetermined value.

According to another aspect of the present invention, when the desired color is outside of the color gamut, the method finds an intersection $(x_i, y_i)$ on a boundary of the color gamut with a line connecting the desired color and an achromatic point; and evaluates $f(x_i, y_i)$ to obtain luminous intensity $\hat{Y}$ and LED drive vector $\hat{b}$ for the desired color. That line between the desired color and the achromatic point may be a line of constant hue, which is a straight line in a uniform color space is used.

The present invention is better understood upon consideration of the detailed description below in conjunction with the accompanying drawings.

DETAILED DESCRIPTION OF THE PREFERRED EMBODIMENTS

Figure 1:
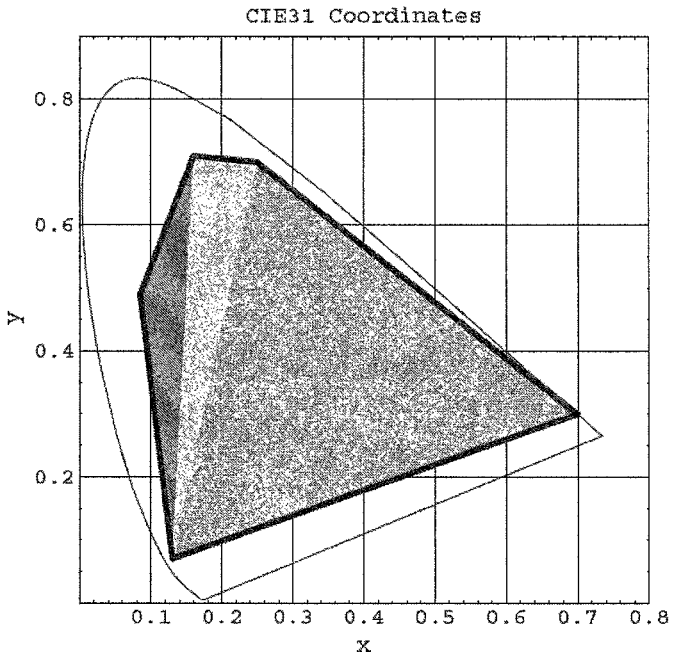
FIG. 1 shows an example of a color gamut defined by five basis colors.

With more than three basis colors, there are multiple combinations of LED drives that can display a given color at a given luminance intensity. The additional freedom made possible by using more than three basis colors allows expanding the color gamut at lower levels of luminance intensity to provide highly-saturated colors, even in systems using CSF to control brightness. According to one embodiment of the present invention, the LED drive vector b required to produce a given luminous intensity Y at each color is provided within the possible color gamut, subject to desired constraints or conditions.

In one method, the color gamut is sampled, and the maximum luminous intensity $\hat{Y}$ and the required drive vector $\hat{b}$ for displaying each of the sampled color are calculated. For each LED string in a pixel, this calculation requires only knowledge of the number of the LEDs in the LED string and the specifications of the LED string used to produce a basis color in the pixel. The sampled colors may then be used to construct an interpolating function that allow rapid access to the calculated LED drive vector and the luminous intensity. The interpolating function can be constructed offline, independently of real-time operations. The calculated values may be provided, for example, in a look-up table indexed by the color coordinates of the sampled colors. Such a table may be made accessible, for example, by a system that controls image display on a LED display signboard.

During real time operations, the interpolating function is applied to each color to be displayed on the LED display. The desired color may be specified, for example, using the chromatic coordinates (x, y). The interpolating function then returns the maximum possible luminous intensity $\hat{Y}$ and the required drive vector $\hat{b}$. If the desired pixel luminous intensity Y does not exceed $\hat{Y}$, the drive vector required to have pixel colorimetric coordinates (x, y, Y) may be linearly scaled, i.e., the desired drive vector is given by $$\frac{Y}{\hat{Y}}\hat{b}.$$

Such a scaling operation may be achieved by a mere few multiplications.

The equations represented by equation 2a), together with the constraint $0 \le b_p \le 1$, p being the number of basis colors, provide the colorimetric requirement that vector equation Ab=v is to be satisfied, subject to the vector constraint $0 \le b \le 1$. Other constraints may also be incorporated to model the physical characteristics of the LEDs, power supplies, thermal limits and other desiderata. Generally, the required values of vector b may be found using a mathematical programming technique in which the constraints and an objection function are expressed as nonlinear functions of the variables that are to be adjusted to minimize (or maximize) the objective function. Luenberger[2] has characterized the general mathematical programming problem as follows:

[2] David G. Luenberger and Yinyu Ye, *Linear and Nonlinear Programming* (*Third Edition*), page 4, International Series in Operations Research & Management Science, Springer Science+Business Media, LLC, New York (2010).

Minimize $f(x)$ subject to:

$$h_i(x)=0 \quad i=1,2,\ldots,m$$

$$g_j(x)\le 0 \quad j=1,2,\ldots,n$$

$$x\in S$$

Where x is an n-dimensional vector of unknowns, $f$, $h_i$ and $g_j$ are real-valued functions of the elements of x. The set S is a subset of n-dimensional space. The function $f$ is the "objective function" of the problem and the equations, inequalities and set restrictions are collectively referred to as the "constraints".

If both the objective function and constraints are linear in the variables, linear programming techniques may be used, otherwise nonlinear programming techniques are applied. Linear programming may be considered a special case of nonlinear programming; however, special methods that take advantage of linearity of the objective function and the constraints may provide superior performance.

According to one embodiment of the present invention, suppose a desired color is represented by the pair (x, y) and a matrix A of basis color specifications, constraints C1, C2 and C3 are applicable for finding a maximum luminance intensity Y at (x, y):

$$C_1(Y):\ Ab=\frac{Y}{y}\begin{bmatrix} x \\ y \\ 1-x-y \end{bmatrix} \tag{5a}$$

$$C_2:\ 0 \le b \le 1 \tag{5b}$$

$$C_3:\ Eb \le e \tag{5c}$$

Constraint C1 ensures that the chromaticity coordinates are correct, constraint C2 ensures that each basis color LED drive is non-negative and is not more than the maximum drive, and constraint C3 controls the variation of the maximum luminous intensity available over the gamut. Constraint C3 is shown here as a linear inequality of matrix E and vector e (see discussion below in conjunction with FIGS. 3 and 4); which allows finding the maximum luminous intensity to be stated as a linear program. In general, however, constraint C3 may be nonlinear, so that finding the maximum luminous intensity is a nonlinear programming problem. Stated formally, the maximum luminous intensity and associated control vector $\hat{b}$ are found by solving:

$$\hat{Y},\hat{b}=\{\hat{Y}\ge Y,b \mid C_1(\hat{Y}),C_1(Y),C_2,C_3\} \tag{5)}$$

If pair (x, y) is not in the gamut implied by matrix A then the solution to equation 5) is $\hat{b}$=0 and $\hat{Y}$=0 Equation 5) sets forth a standard linear programming problem by solving for Y in one of the rows of $C_1(Y)$ (the second is most convenient), and substituting the resulting Y value into the other rows of $C_1(Y)$. Applicable linear programming techniques may be found, for example, in *Numerical Recipes* in C, by William H. Press, Brian P. Flannery, Saul A. Teukolslcy, and William T. Vetterling, pp. 329-343, Cambridge University Press, New York (1988). (Also, see additional references on page 343).

Denoting the i-th row of matrix A by $A_i$, constraint $C_1(Y)$ may be written as:

$$A_1 b = \left(\frac{x}{y}\right)Y \qquad 6a)$$
$$A_2 b = Y$$
$$A_3 b = \left(\frac{1-x-y}{y}\right)Y$$

Substituting the second row of equation 6a) into the other two rows yields:

$$\left(A_1 - \left(\frac{x}{y}\right)A_2\right)b = 0 \qquad 6b)$$
$$A_2 b = Y$$
$$\left(A_3 - \left(\frac{1-x-y}{y}\right)A_2\right)b = 0$$

The problem of equation 5 becomes maximizing $A_2$ b, subject to:

$$\left(A_1 - \left(\frac{x}{y}\right)A_2\right)b = 0 \qquad 7)$$
$$\left(A_3 - \left(\frac{1-x-y}{y}\right)A_2\right)b = 0$$
$$0 \le b \le 1$$
$$Eb \le e$$

The control vector $\hat{b}$ that provides maximum luminous intensity $\hat{Y}=A_2\hat{b}$ for the given chromaticity coordinates (x, y), pixel LED specification matrix A and applicable constraints may be obtained off line, for example, using linear programming techniques.

If constraint $C_3$, the objective function $f$, or both, are nonlinear, the problem may be solved using a nonlinear programming technique. In that case, rather than equation 7, the problem is expressed as:

maximizing $f(b)$, subject to:

$$\left(A_1 - \left(\frac{x}{y}\right)A_2\right)b = 0 \qquad 8)$$
$$\left(A_3 - \left(\frac{1-x-y}{y}\right)A_2\right)b = 0$$
$$0 \le b \le 1$$
$$g(b) \le 0$$

where $f$ is a real scalar-valued function and g is a vector-valued function with real-valued elements.

It is important to notice that solution of either the linear or nonlinear programming problem need not be done in real-time, but, rather, can be done offline. This follows since the possible values of the chromaticity coordinates are in a compact set (the gamut) and it is possible to simply construct an interpolator using samples within the set to allow calculation (approximate, but with arbitrary accuracy) of all values within the gamut.

One goal of accommodating colors that are outside of the gamut provided by the basis colors is hue preservation. Approximately constant hue lines are provided by the lines of the ratio $$\frac{b^*}{a^*}$$

in the CIE L*a*b* uniform color space or the line of the ratio $$\frac{v^*}{u^*}$$

in the CIE L*u*v* uniform color space. Approximately constant hue lines are discussed, for example, in *Color Science: Concepts and Methods, Quantitative Data and Formulae, 2nd Edition*, by Gunter Wyszecki and W. S. Stiles, John Wiley & Sons, Inc., New York (1982). See pages 168-169. The CIE L*u*v* uniform color space provides straight lines of constant hue in the (x, y) plane. An approximately constant hue line emanates from an achromatic point ($x_n$, $y_n$) and extends to the spectral locus or the purple line. An achromatic point may be, for example, the white point D65 at ($x_n$, $y_n$)= (0.3127, 0.3290).

When a desired color (x, y) is not in the gamut, the point on the boundary of the gamut where the boundary intersects the line connecting color (x, y) with the achromatic point may be selected, i.e., the maximum luminous intensity $\hat{Y}$ and the LED drive $\hat{b}$ of that intersection point representing the approximation to the desired color. Such an approximation best retains hue in the CIE L*u*v* uniform color space.

The above discussion may be summarized by the method set forth in the following. The method describes an exactly solution where available; and an approximation solution that gives the nearest pixel color in a CIE uniform color space, where an exact solution is not available. The accuracy after interpolation depends on the grid mesh size. In general, a finer mesh size provides a smaller error.

Offline Calculations:

a) Given LED drive specification matrix A and in a grid of points (x, y) that cover at least the area bounded by the spectral locus and purple line or another CIE color gamut:
   (1) finding the maximum luminous intensity $\hat{Y}$ and the associated LED drive vector $\hat{b}$ for each of a collection of sample colors in the grid, each sampled color having chromaticity coordinates ($x_n$, $y_n$), n=0, 1, . . . , N, for example, using either (a) a linear programming technique, based on the linear programming problem posed in equations 7), or (b) a non-linear programming technique, based on the non-linear programming problem posed in equations 8;
   (2) If the value of maximum luminous intensity $\hat{Y}>0$ for the sampled color, then returning luminous intensity $\hat{Y}$ and LED drive vector $\hat{b}$;
   (3) otherwise:
      (i) finding the color at the intersection ($x_i$, $y_i$) on a boundary of the color gamut between the boundary and the line passing through (x, y) and ($x_n$, $y_n$), the intersection being provided as an approximation for the sampled color; and
      (ii) finding the maximum luminous intensity $\hat{Y}$ and the associated LED drive vector $\hat{b}$ for the approximate color, using either (a) a linear programming technique, based on the constraints of Equations 7), or (b) a non-linear programming technique, based on the non-linear programming problem posed in equations 8; and (iii) returning luminous intensity $\hat{Y}$ and LED drive vector $\hat{b}$ for the approximation color; and b) based on the returned luminous intensity $\hat{Y}$ and LED drive vector $\hat{b}$ for each sampled colors or their approximations, creating a function $f(x, y)$ with a domain in $R^2$ and a range in $R^{P+1}$ as typically constructed from P+1 one-dimensional interpolation functions, to interpolate luminous intensity $\hat{Y}$ and LED drive vector on the grid of points (x, Y).

The interpolation function $f(x, y)$ thus obtained is used for real time determination of the LED drive for colors of an image to be displayed on a LED signboard.

Real Time Calculations:

For each pixel:

(1) given chromaticity coordinates and luminous intensity (x, y, Y) to be displayed, evaluating $f(x, y)$ to obtain luminous intensity $\hat{Y}$ and LED drive vector $\hat{b}$; and (2) returning the LED drive vector as $$\hat{b}\min\left(\frac{Y}{\hat{Y}}, 1\right).$$

Typically, the real time calculations require only a few multiply and add operations for each pixel.

Some numerical examples of the methods discussed above are illustrated in conjunction with FIGS. 2-4. These examples are based on an LED drive specification provided in Table 1:

TABLE 1

| Color | CIE Tristimulus Coordinates x | y | Y(cd) |
|---|---|---|---|
| Blue | 0.13 | 0.07 | 1.56 |
| Cyan | 0.085 | 0.49 | 2.2 |
| Green | 0.16 | 0.71 | 2.92 |
| Green-Yellow | 0.25 | 0.7 | 2.56 |
| Red | 0.7 | 0.3 | 2.56 |

Based on equations 4a), 4b) and 4c) above, the following CIE XYZ specification matrix A is obtained:

$$\begin{bmatrix} 2.8971 & 0.3816 & 0.6580 & 0.9143 & 5.9733 \\ 1.56 & 2.2 & 2.92 & 2.56 & 2.56 \\ 17.8286 & 1.9082 & 0.5346 & 0.1829 & 0 \end{bmatrix} \quad 9)$$

Figure 2:
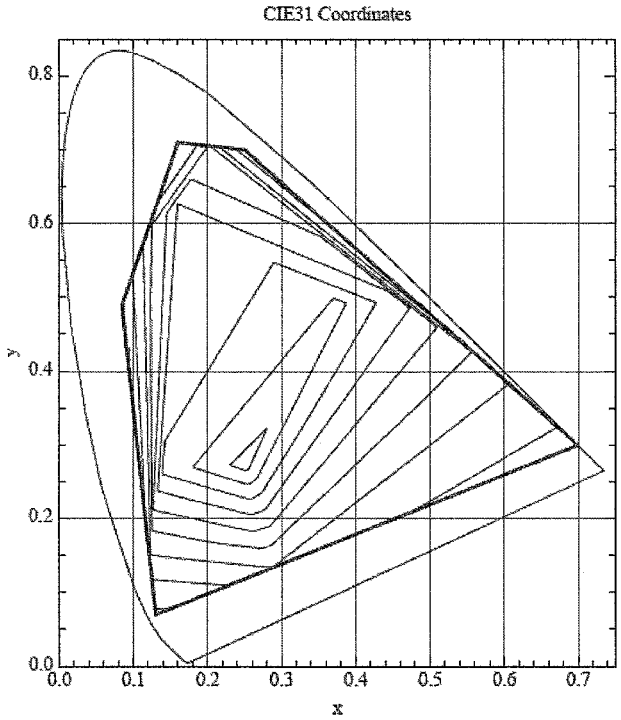
FIG. 2 shows the CIE spectral locus and purple line, the boundary (enclosed by thick lines) of the color gamut defined by the basis color LEDs which are represented by matrix A in Eq. 8) and multiple contours of constant luminous intensity.

In these numerical examples, the Constraints C1 and C2 are applicable. In the example of FIG. 2, Constraint C3 is inactive or absent. FIG. 2 depicts results from applying a method of the present invention on a system having five strings of LEDs per pixel (P=5 under the convention of Equation 1). FIG. 2 shows the CIE spectral locus and purple line, the boundary (enclosed by thick lines) of the color gamut defined by the basis color LEDs described by the matrix A in Eq. 9) and multiple contours of constant luminous intensity. As shown in FIG. 2, beginning from the small innermost contour, the contours correspond to values {0.95, 0.85, 0.75, . . . , 0.05} times the largest value of $\hat{Y}$ over the entire gamut. As provided in this example, the largest value of $\hat{Y}$ over the entire gamut is 11.8 candela. Considerable variations in the maximum available luminous intensity are seen over a large part of the useful gamut.

Figure 3:
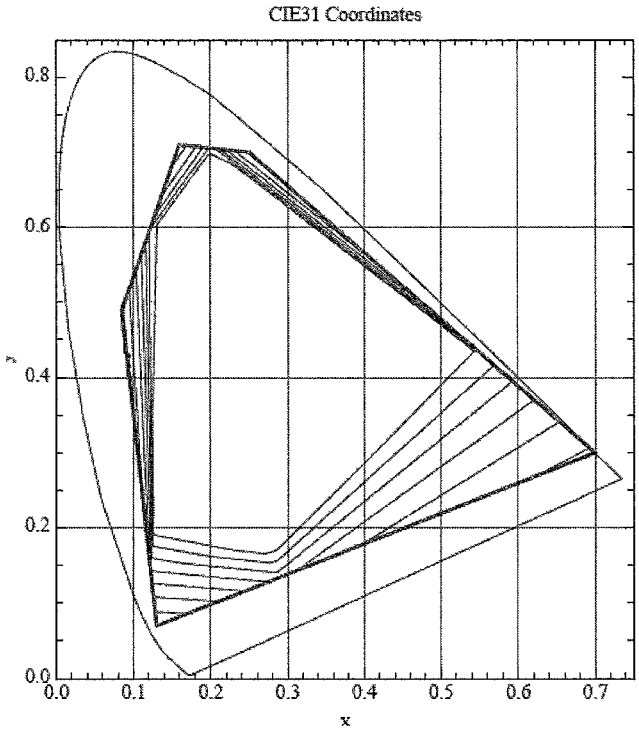
FIG. 3 shows contours of constant luminous intensity at {0.95, 0.85, 0.75, . . . , 0.05} times the maximum available luminous intensity (in this case, $\hat{Y}$=5.9 candela) and ρ=0.5, as obtained using constrained LED drive currents.
Figure 4:
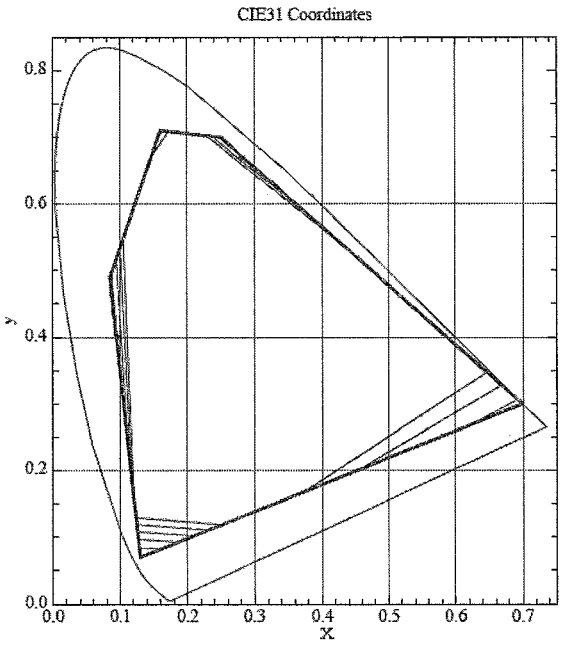
FIG. 4 shows contours of constant luminous intensity at {0.95, 0.85, 0.75, . . . , 0.05} times the maximum available luminous intensity (in this case, $\hat{Y}$=3.54 candela) and ρ=0.3, as obtained using constrained LED drive currents.

The variation in the maximum available luminous intensity over much of the useful gamut may be limited by constraint C3 when preparing the data for representing the drive to the LED strings. One choice for the matrix E and vector e in constraint C3 is:

$$E = A_2 \quad 10a)$$

$$e = \left[\rho \sum_{i=1}^{P} A_{2i}\right] \quad 10b)$$

where $0<\rho\leq 1$ and $A_2$/is the i-th element of the second row of matrix A. Substituting the element values from A in Equation 8) results in $$E/1.56\ 2.2\ 2.92\ 2.56\ 2.56]$$

$$e=/1.8\rho]$$

when $\rho=1$, there is effectively no constraint (i.e., the unconstrained condition of FIG. 2), as because $\hat{Y}=A_2\hat{b}$ is always active. As $\rho$ is decreased the maximum luminous intensity over the gamut is decreased while the minimum values are not changed until the value of $\rho$ is small. FIGS. 3 and 4 show the cases for $\rho=0.5$ and $\rho=0.3$, respectively. Note that maximum luminous intensity is possible for a larger quantity of highly saturated colors as p becomes smaller.

As mentioned above, a linear programming solution may be considered a special case of a general nonlinear programming solution. A nonlinear programming problem may be obtained by generalizing the objective function $f$, or one or more of the constraints. For example, the non-linear problem of equations 8) is obtained from equations 7) by substituting $A_2b$ by $f(x)$ and $Eb-e$ by $g(x)$. Such generalization increases the diversity of possibilities available for gamut control. Some examples of such increased diversity include more detailed power control, smoothness of the drive vector as a function of color (thereby allowing fewer samples to be used to define the interpolator), better distribution of power dissipation among LED strings used in the pixels, and generally more fine-grained control over gamut distribution.

Figure 5:
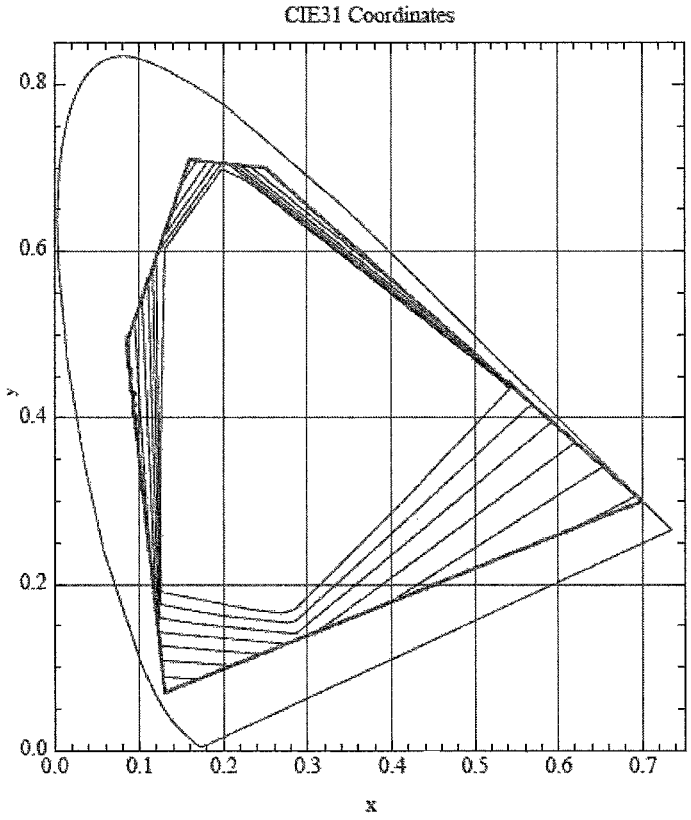
FIG. 5 shows, contours of constant luminous intensity at {0.95, 0.85, 0.75, . . . , 0.05} times the maximum available luminous intensity (in this case, $\hat{Y}$=5.9 candela) and ρ=0.5, as obtained using non-linear constrained LED drive currents and an objective function $f(x)=(Ab)^T(Ab)$.

For example, nonlinear programming can be used to increase the smoothness of the drive vector as a function of color. Changing the objective function $f(x)$ to the nonlinear function $f(x)=(Ab)^T(Ab)$ can reduce the peak magnitude of difference quotient of $\hat{b}$ with respect to {x, y} by a factor of about two. The resulting gamut coverage, as displayed in FIG. 5, is almost unchanged from that obtained from the linear program given in equations 7), as shown in FIG. 3.

The detailed description above is provided to illustrate the specific embodiments of the present invention and is not intended to be limited. Numerous variations and modifications within the scope of the present invention are possible. The present invention is set forth in the following claims.

I claim:

1. A method for displaying a desired color at chromaticity coordinates and a desired luminous intensity on a pixel formed by a plurality of LEDs or LED strings, the pixel being capable of displaying colors defined by a color gamut, the method comprising:

finding a maximum luminous intensity and an associated LED drive vector for each of a selected set of colors in the color gamut using a mathematical programming technique subject to one or more constraints, wherein one of the constraints constrains a function of each of the associated LED drive vectors to be less than or equal to a predetermined value;

calculating the LED drive vector for the desired color at the desired luminous intensity based on the maximum luminous intensities and the associated LED drive vectors for the selected set of colors; and using the LED drive vector for the desired color to drive the plurality of LEDs or LED strings so as to display the desired color on the pixel.

2. The method of claim 1, wherein said finding the maximum luminous intensity and the associated LED driver vector for each of the selected set of colors in the color gamut uses a linear programming technique.

3. The method of claim 1, wherein said finding the maximum luminous intensity and the associated LED driver vector for each of the selected set of colors in the color gamut uses a non-linear programming technique.

4. The method of claim 1, wherein when the desired color is not one of the colors in the selected set of colors for which the maximum luminous intensities and the associated drive vectors are found, the method further comprising providing an approximate maximum luminous intensity and an approximate LED drive vector for the desired color.

5. The method of claim 4, wherein said providing an approximate maximum luminous intensity and an approximate LED drive vector for the desired color comprises:

creating an interpolation function for interpolating the maximum luminous intensities and the associated LED drive vectors for the selected set of colors, and evaluating the interpolating function to calculate the approximate maximum luminous intensity and the approximate LED drive vector for the desired color.

6. The method of claim 4, wherein the LED drive vector for the desired color is obtained by scaling the approximate LED drive vector for the desired color, using a ratio of the desired luminous intensity over the approximate maximum luminous intensity for the desired color.

7. The method of claim 5, wherein the interpolation function is created off-line.

8. The method of claim 1, wherein said finding the maximum luminous intensities and the associated drive vectors for the selected set of colors is performed off-line.

9. The method of claim 5, wherein said evaluating the interpolation function to calculate the approximate maximum luminous intensity and the approximate LED drive vector for the desired color is carried out in real time.

10. The method as in claim 1, wherein one of the constraints constrains variations in the maximum luminous intensities for the selected set of colors in the color gamut to be less than or equal to a predetermined value.

11. The method of claim 10, wherein the maximum luminous intensities for the selected set of colors comprise high luminous intensities for highly saturated colors.

12. The method of claim 1, wherein one of the constraints is a non-linear function of the LED drive vector.

13. The method of claim 1, wherein when the desired color is outside of the color gamut, the method further comprises:

finding an intersection point on a boundary of the color gamut of a line connecting the desired color and an achromatic point; and using chromaticity coordinates of the intersection point to approximate the desired color in calculating the LED drive vector.

14. The method of claim 13, wherein the line connecting the desired color and the achromatic point is a line of constant hue.

15. The method of claim 13, wherein the intersection point is found using a uniform color space.

16. The method of claim 1, wherein the colors that can be displayed by each pixel is defined by a specification matrix of basis colors of the plurality of LEDs or LED strings.

17. A system to control a pixel formed by a plurality of LEDs or LED strings and capable of displaying colors defined by a color gamut, comprising:

an LED driver, wherein the LED driver is configured to:

receive a desired color expressed as chromaticity coordinates and a desired luminous intensity;

use a mathematical programming technique to find a maximum luminous intensity and an associated LED drive vector for each of a selected set of colors in the color gamut subject to one or more constraints, wherein one of the constraints constrains a function of each of the associated LED drive vectors to be less than or equal to a predetermined value;

calculate the LED drive vector for the desired color at the desired luminous intensity based on the maximum luminous intensities and the associated LED drive vectors for the selected set of colors; and use the LED drive vector for the desired color to drive the plurality of LEDs or LED strings so as to display the desired color on the pixel.

18. The system of claim 17, wherein when the desired color is not one of the colors in the selected set of colors for which the maximum luminous intensities and the associated drive vectors are found, the LED driver is further configured to create an interpolation function to interpolate the maximum luminous intensities and the associated LED drive vectors for the selected set of colors, and evaluate the interpolation function to calculate an approximate maximum luminous intensity and an approximate LED drive vector for the desired color.

19. The system of claim 17, wherein one of the constraints constrains variations in the maximum luminous intensities for the selected set of colors in the color gamut to be less than or equal to a predetermined value.

20. The system of claim 19, wherein the maximum luminous intensities for the selected set of colors comprise high luminous intensities for highly saturated colors.

* * * * *

UNITED STATES PATENT AND TRADEMARK OFFICE

CERTIFICATE OF CORRECTION

PATENT NO. : 8,791,890 B2
APPLICATION NO. : 13/080480
DATED : July 29, 2014
INVENTOR(S) : Paul O. Scheibe It is certified that error appears in the above-identified patent and that said Letters Patent is hereby corrected as shown below:

Title Page line 17, item (57) ABSTRACT

"$\hat{b}\min(\frac{Y}{\hat{Y}}, 1)$" should be -- $\hat{b}\ \min(\frac{Y}{\hat{Y}}, 1)$ --

Title Page line 20, item (57) ABSTRACT

"we" should be --the--

Signed and Sealed this
Eighteenth Day of November, 2014

Michelle K. Lee

Michelle K. Lee
*Deputy Director of the United States Patent and Trademark Office*